US011690431B2

(12) United States Patent
DeGroot

(10) Patent No.: US 11,690,431 B2
(45) **Date of Patent: *Jul. 4, 2023**

(54) MAGNETIC SHOULDER STRAPS FOR A CARRYING DEVICE

(71) Applicant: Melissa S. DeGroot, Cincinnati, OH (US)

(72) Inventor: Melissa S. DeGroot, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/647,625

(22) Filed: Jan. 11, 2022

(65) Prior Publication Data

US 2022/0133010 A1 May 5, 2022

Related U.S. Application Data

(63) Continuation-in-part of application No. 16/853,987, filed on Apr. 21, 2020, now Pat. No. 11,278,097.

(51) Int. Cl.

| | |
|---|---|
| ***A45C 13/10*** | (2006.01) |
| ***A45C 3/00*** | (2006.01) |
| ***A45C 13/26*** | (2006.01) |

(52) U.S. Cl.

CPC ..... *A45C 13/1069* (2013.01); *A45C 3/001* (2013.01); *A45C 13/26* (2013.01)

(58) Field of Classification Search

CPC ..... A45C 13/1069; A45C 13/30; A45C 13/26
USPC ..... 150/107; 224/183
See application file for complete search history.

(56) References Cited

U.S. PATENT DOCUMENTS

| | | | | |
|---|---|---|---|---|
| 733,542 | A * | 7/1903 | Converse | B65D 88/1618 383/17 |
| 2,842,277 | A | 7/1958 | Jewell | |
| 2,856,111 | A | 10/1958 | Wolfe et al. | |
| 3,265,168 | A * | 8/1966 | Erhard | A45C 13/26 190/117 |
| 3,627,177 | A | 12/1971 | Marcus | |
| 3,768,684 | A | 10/1973 | Buchtel | |
| 3,883,024 | A | 5/1975 | Thomas | |
| 3,998,360 | A | 12/1976 | Mack | |
| 4,883,175 | A | 11/1989 | Thiele et al. | |
| 5,682,653 | A * | 11/1997 | Berglof | G09F 1/10 224/183 |
| 5,743,451 | A | 4/1998 | Kahn | |
| 6,052,828 | A | 4/2000 | Widdemer | |

(Continued)

FOREIGN PATENT DOCUMENTS

WO WO-03065839 A1 * 8/2003 ..... A45C 13/26

*Primary Examiner* — Justin M Larson
(74) *Attorney, Agent, or Firm* — FisherBroyles, LLP; Susan M. Oiler

(57) ABSTRACT

Carrying devices with a pair of shoulder straps are disclosed. Each strap of the pair of shoulder straps has a first textile layer sewingly stitched to a second textile layer that is shorter than the first with at least one magnet positioned and enclosed therebetween proximate or at a central transverse plane to form an intermediate. A third textile layer is sewingly stitched to the intermediate along each longitudinal edge to form the strap. The polarity of the magnet(s) in the first strap and the polarity of the magnet(s) in the second strap are oriented with the same polarity facing a top surface thereof, thereby the first strap is magnetically attractable to the second strap with a bottom surface of the first strap in direct contact with a top surface of the second strap or vice versa.

13 Claims, 12 Drawing Sheets

(56) References Cited

U.S. PATENT DOCUMENTS 6,224,537 B1 5/2001 Shin
7,111,364 B2 9/2006 Bader et al.
7,175,143 B1 2/2007 Ho
7,232,105 B2 6/2007 Want et al.
7,286,803 B2 10/2007 Hamasaki et al.
7,429,024 B2 9/2008 Boklund-Moran
7,610,944 B2 11/2009 Reiter
7,740,222 B2 6/2010 Wang
7,806,309 B2 * 10/2010 Korchmar ..... A45F 3/14 224/183
8,002,225 B1 8/2011 Malone
8,096,517 B1 1/2012 Hamilton
8,316,515 B2 * 11/2012 Slank ..... A41F 1/002 24/306
8,408,791 B1 * 4/2013 Wang ..... B65D 33/02 383/104
9,876,885 B1 1/2018 Velasquez
9,985,678 B1 5/2018 Sumida et al.
10,003,681 B1 6/2018 Hsu
10,076,169 B2 * 9/2018 Clough ..... A45C 13/1069
10,132,340 B2 * 11/2018 Russell-Clarke .. A44B 17/0005
10,226,110 B2 * 3/2019 Hayashi ..... A45C 13/103
10,413,027 B1 9/2019 Olson et al.
10,856,633 B2 12/2020 Stagge
11,083,263 B2 8/2021 Reyes
11,132,021 B2 9/2021 Diehl
2003/0014592 A1 8/2003 Lee
2003/0145927 A1 * 8/2003 Lee ..... A45C 13/26 150/107
2003/0230606 A1 * 12/2003 Devinie ..... A45F 5/00 224/183
2005/0102802 A1 * 5/2005 Sitbon ..... A45C 13/1069 24/303
2005/0178631 A1 * 8/2005 Fenton ..... A45F 5/10 383/11
2005/0250974 A1 * 11/2005 Bailey ..... A61N 2/06 600/15
2006/0027613 A1 * 2/2006 Chang ..... A45F 3/04 224/183
2007/0193902 A1 * 8/2007 Myers ..... A45C 13/1069 206/320
2008/0169411 A1 7/2008 Quinn et al.
2010/0267431 A1 10/2010 Fratti et al.
2011/0309117 A1 12/2011 Roberts
2014/0124521 A1 5/2014 Brown
2014/0312083 A1 * 10/2014 Scott ..... A45F 5/021 224/183
2015/0163929 A1 6/2015 Wang
2017/0280840 A1 * 10/2017 Platt ..... A45C 1/02
2019/0183222 A1 * 6/2019 Hayashi ..... A45C 3/06
2020/0083921 A1 3/2020 Hogue

* cited by examiner

MAGNETIC SHOULDER STRAPS FOR A CARRYING DEVICE

TECHNICAL FIELD

This application relates to magnetic shoulder straps for a carrying device, more particularly, to magnetic shoulder straps for a bag carried on one shoulder of the user where the pair of shoulder straps are magnetically attached to one another in an overlapped position while on the shoulder.

BACKGROUND

Handbags, tote bags, travel bags, etc. that have two shoulder length straps suffer from the same reoccurring issue—the top strap, while on the same shoulder of the user, falls off repeatedly. The user either has to continually reposition the slipping strap on their shoulder or has to grasp both straps in one hand as he/she moves or walks. There is a need to connect the two shoulder straps to one another to maintain their relative position during use.

SUMMARY

In all aspects, disclosed herein are a pair of magnetic shoulder straps for a carrying device that are magnetically attracted to one another to prevent the slippage of the outermost strap from the shoulder of the user. With the straps placed directly on top of one another and the magnetic areas overlapping, the top strap will not fall off of the shoulder of a user.

In all aspects, carrying devices are disclosed that have a carrying body defining an interior storage compartment having an access opening thereto and having a pair of shoulder straps defining an opening sized to receive the arm of a user and to rest upon a shoulder of the user. Each individual strap of the pair of shoulder straps has a first textile layer sewingly stitched to a second textile layer that is shorter than the first textile layer with at least one magnet positioned and enclosed between the first textile layer and the second textile layer at a position proximate or at a central transverse plane that divides the first textile layer into a left and right half to form an intermediate (I). The second textile layer has a length sufficient to cover the at least one magnet. A third textile layer is sewingly stitched to the intermediate along each longitudinal edge by edge stitching with the second textile layer between the first textile layer and the second textile layer. The polarity of the magnet in a first individual strap and the polarity of the magnet in a second individual strap are oriented with the same polarity facing a top surface thereof, thereby the first strap is magnetically attractable to the second strap with a bottom surface of the first strap in direct contact with a top surface of the second strap or with a bottom surface of the second strap in direct contact with a top surface of the first strap. The carrying device may be a tote bag, a carry-on bag, a handbag, a shopping bag, lap-top bag, travel bag, diaper bag, pet carrier, and a beach bag.

In one aspect, the magnet is a round magnet and the stitching in the intermediate is a circular pattern around the round magnet. In one embodiment, the magnet(s) is/are adhered to one of the first or second textile layers with an adhesive. In another embodiment, two magnets are present and are spaced a preselected distance from one another proximate the central transverse plane. In all embodiments, the stitching in the intermediate can follow the perimeter of each respective magnet, thereby having generally the same shape as the magnet. In all embodiments, the second textile layer can be hidden between the first and third textile layers. In one embodiment, the second textile layer is an interfacing textile material.

In another aspect, methods of making a pair of shoulder straps are disclosed. Four strips of textile material each having a preselected length and each having a preselected width for making a shoulder strap and two pieces of intermediate textile material that are shorter and have the same or a smaller width than the four strips of textile material are provided. Then, a first magnet is positioned with a first polarity thereof facing the back side of the first strip at or proximate a central transverse axis that divides each shoulder strap into a first elongate half and a second elongate half. The first magnet is at or adjacent the central transverse axis. Next, a first piece of the intermediate textile material is placed in direct contact with the first magnet. Thereafter, the intermediate textile material is stitched to the first textile material in a pattern following the perimeter of the first magnet. Lastly, a second strip of the four strips of textile material with a back side thereof facing the intermediate textile material with the length thereof aligned with the length of the first strip is stitched along the length of opposing elongate edges of the first and second textile layers to affix the two to one another. Thereafter, the above is repeated with a third strip of the four strips of textile material, a second piece of the intermediate textile material, a fourth strip of the four strips of textile material, and a second magnet.

The method can also include the application of an adhesive to a back side of a first strip of the four strips of textile material at one or more preselected positions for the at least one magnet. In one embodiment, the adhesive is a heat fusible bond material.

DETAILED DESCRIPTION

Figure 1:
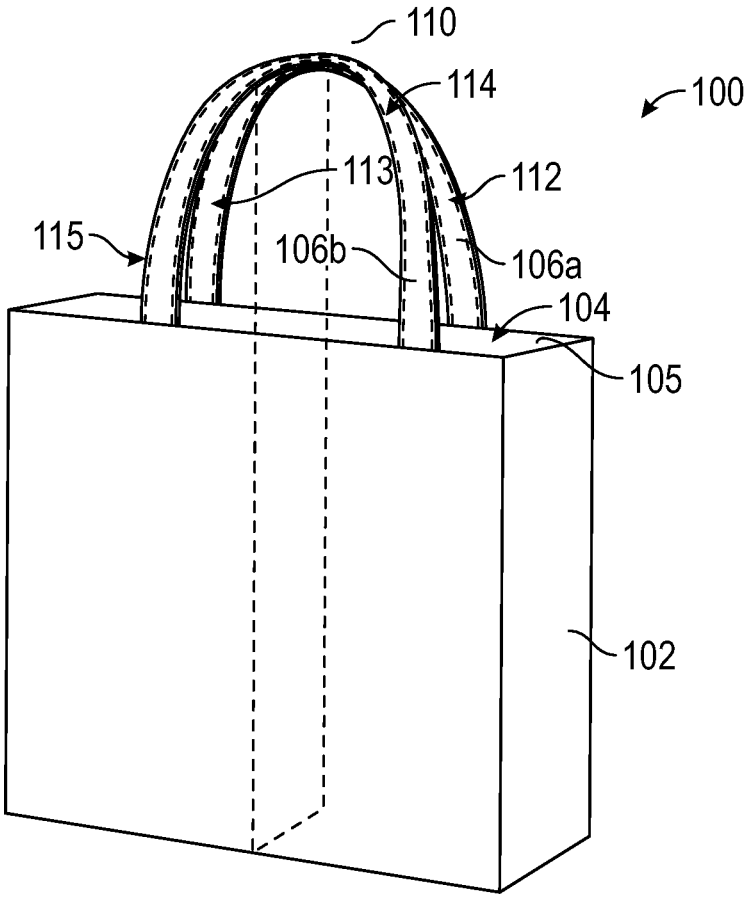
FIG. 1 is a perspective view of one embodiment of a tote bag with shoulder straps.

The following detailed description will illustrate the general principles of the invention, examples of which are additionally illustrated in the accompanying drawings. In the drawings, like reference numbers indicate identical or functionally similar elements.

FIGS. 1-3B illustrate one embodiment of a carrying device 100, such as a tote bag, having a carrying body 102 defining an interior storage compartment 104 having an access opening 105 thereto, which may be open or may be closable by a fastener, such as a zipper, magnetic clasp, hook, snaps, etc. and having shoulder straps 106*a*, 106*b* that each enclose at least one magnet (see FIG. 5) proximate a central transverse plane 110 that divides each shoulder strap 106 into a left and right half based on the orientation of the tote bag in FIG. 1. While the carrying device is illustrated as a tote bag, it is not limited thereto. In other embodiments, the carrying device may be a purse, carryon bag, computer bag, beach bag, travel bag, diaper bag, pet carrier, or any other type of bag typically carried on one shoulder of the user. The first strap 106*a* has a top surface 112 and a bottom surface 113. The second strap 106*b* has a top surface 114 and a bottom surface 115.

Figure 2:
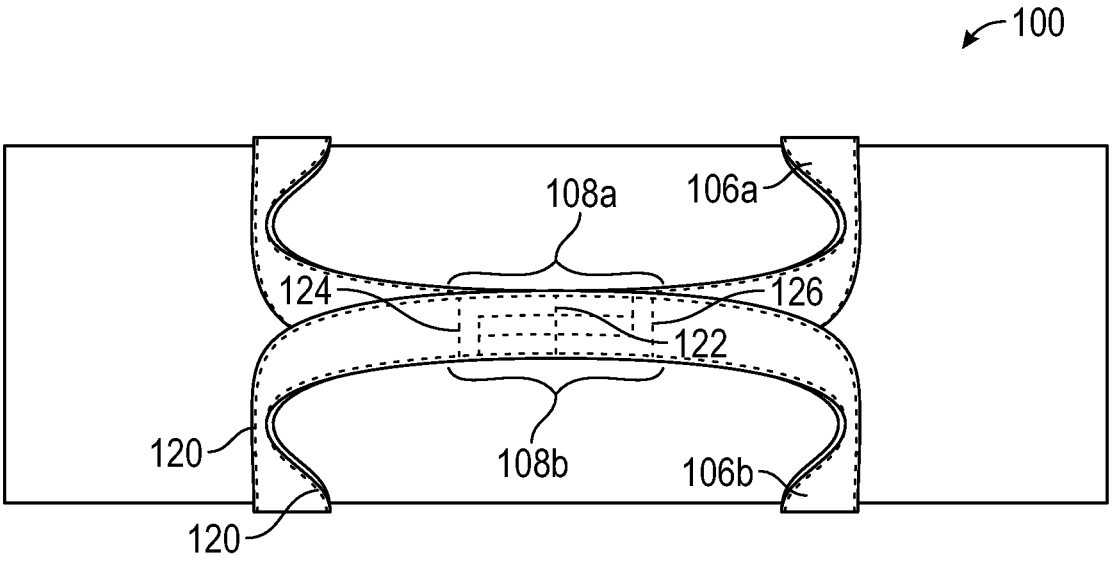
FIG. 2 is a top view of the tote bag with shoulder straps of FIG. 1.
Figure 3A:
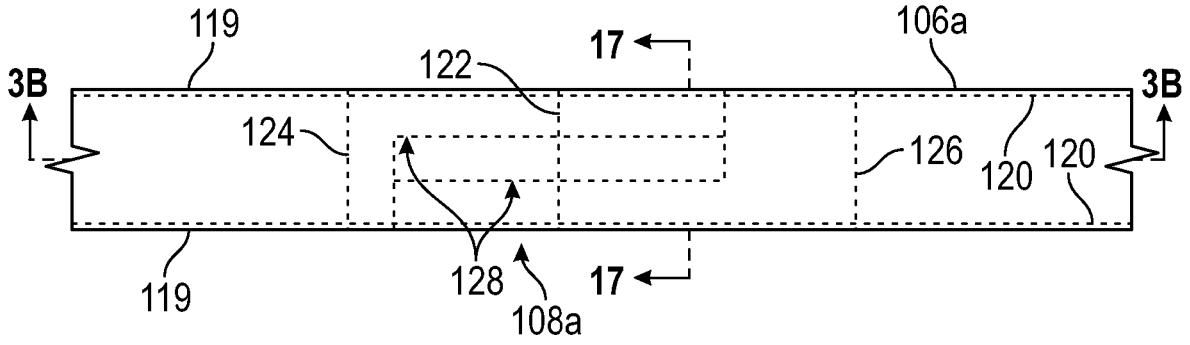
FIG. 3A is an enlarged view of the central portion of one of the shoulder straps of the tote bag with optional ornamental stitching.
Figure 3B:
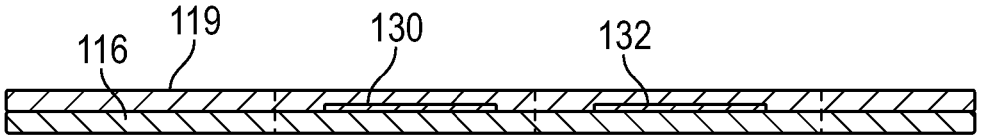
FIG. 3B is a longitudinal cross-sectional view of the shoulder strap of FIG. 3A.
Figure 16:
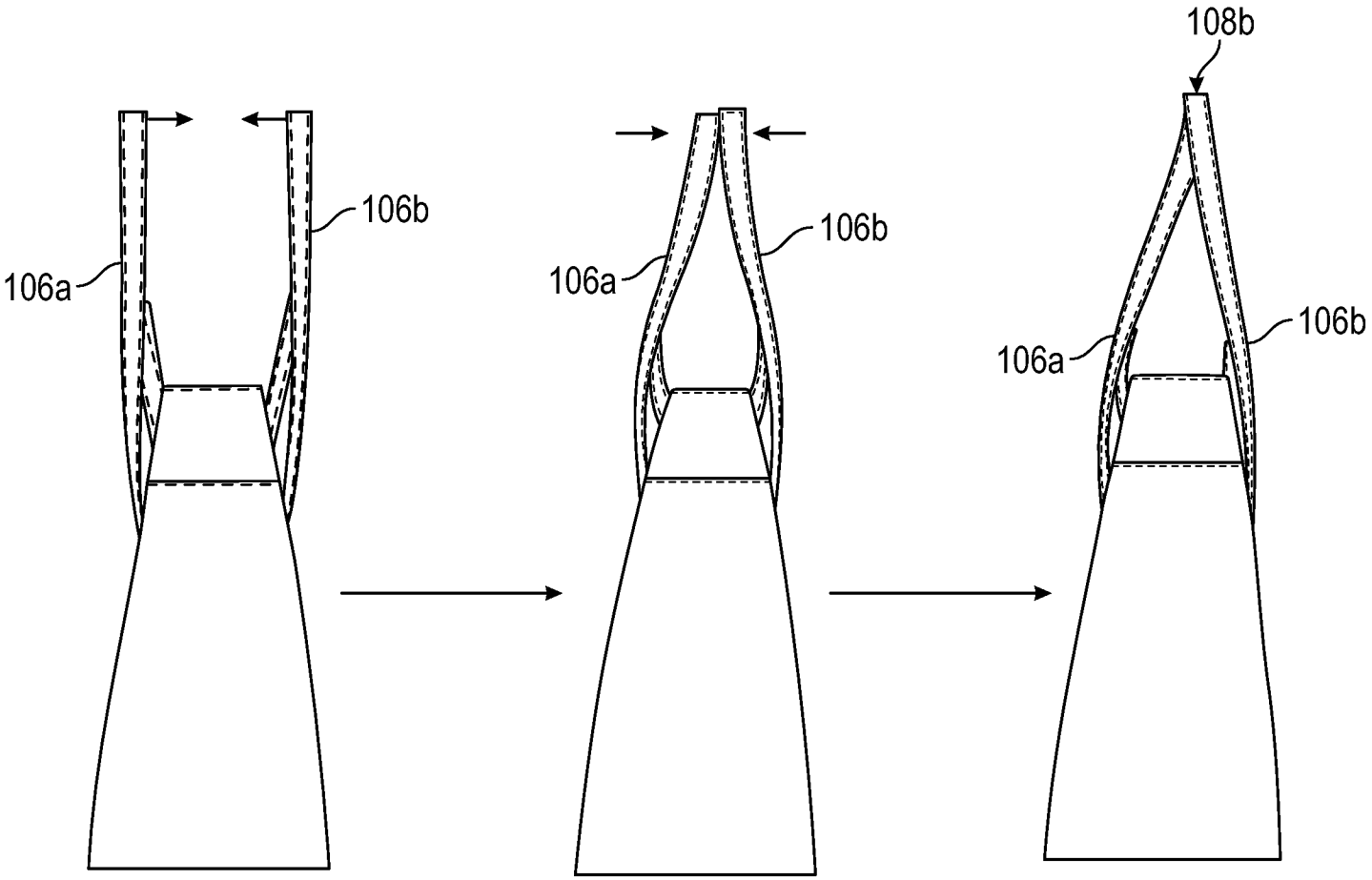
FIG. 16 is a progressive flow of images showing the pair of shoulder straps coming into the magnetically attracted position.
Figure 17:
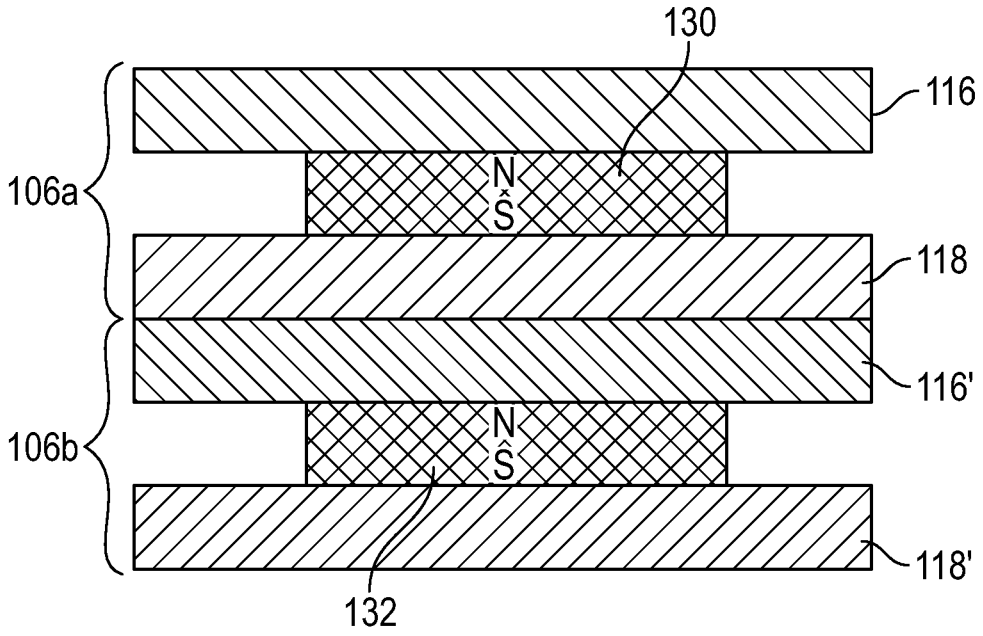
FIG. 17 is a representation of a cross-sectional view through the shoulder straps of FIG. 3 along line 17-17.

In the carrying position shown in FIGS. 1 and 2 and the flow diagram of FIG. 16, second shoulder strap 106*b* is positioned with its central portion 108*b*, which encloses at least one magnet, on top of a central portion 108*a* of the first shoulder strap 106*a*, which also encloses at least one magnet, with its bottom surface 115 seated in direct contact with a top surface 112 of the first shoulder strap 106*a*. However, the magnets in the pair of shoulder straps 106*a*, 10*b* have their polarities oriented (see FIG. 17 and its description below) such that the reverse configuration works as well, i.e., the first shoulder strap 106*a* has its central portion 108*a* on top of the central portion 108*b* of the second shoulder strap 106*b* with the bottom surface 113 on top of the top surface 114. To have either of the pair of shoulder straps 106*a*, 106*b* on top of the other results in a magnetic attraction between the magnets enclosed in the straps, the magnets must be positioned with the same polarity orientated toward the same surface of the respective straps. Referring to FIG. 17, the first magnet 130 in a first strap 106*a* of the pair of shoulder straps has its "north" polarity facing a first textile layer 116 and its "south" polarity facing the second textile layer 118, while the second magnet 132 in the second strap 106*b* of the pair of shoulder straps has its "north" polarity facing the first textile layer 116' and its "south" polarity facing the second textile layer 118'.

Figure 4:
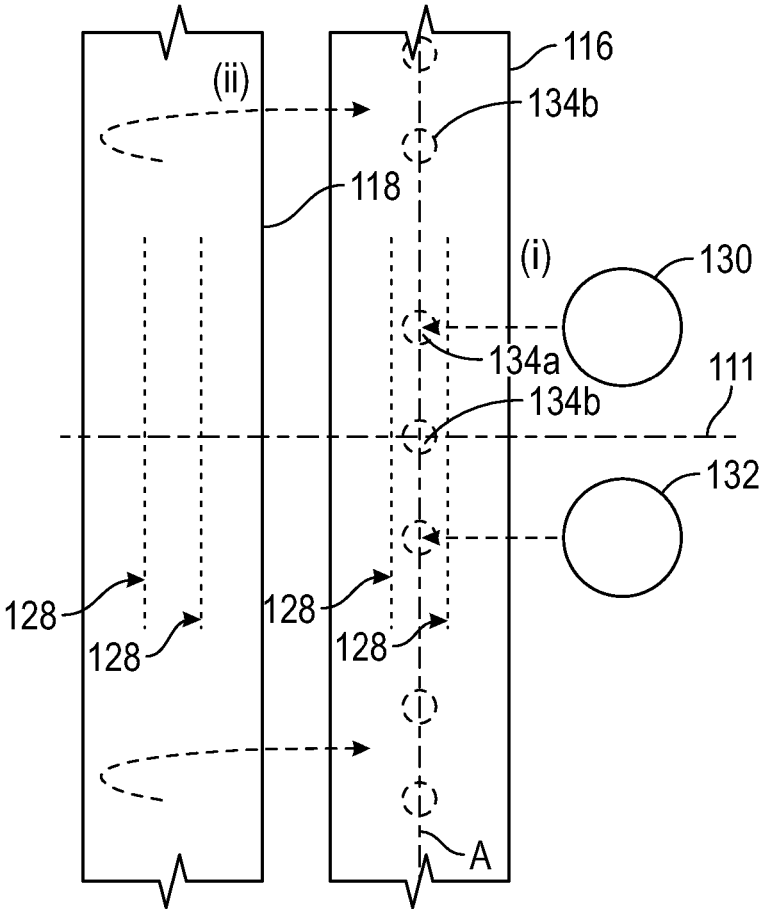
FIG. 4 is an exploded, unassembled view of a central portion of one of the shoulder straps showing the beginning of the order of assembly.

Referring now to FIG. 4, each individual strap 106*a*, 106*b* of the pair of shoulder straps is made from a first textile layer 116 and a second textile layer 118 that may one or both have optional ornamental stitching 128 present before being fixedly attached to one another. During the assembly process, an adhesive 134*a* may be applied to one or both of the first and second textile layers 116, 118 at the position of the first magnet 130 and/or the second magnet 132 to hold the first and/or second magnets 130, 132 in place while the first and second textile layers 116, 118 are fixed to one another by means such as sewn stitching, heat fusible bonding, or adhesive (non-heat activated). Alternately or in addition, adhesive 134*b* may be applied to either or both of the first and second textile layers 116, 118 along the length of the layers to adhere the layers together, which will also hold the magnets 130, 132 in place while the first and second textile layers 116, 118 are sewingly fixed to one another. Regardless of the placement of the adhesive 134*a*, 134*b*, the end result is the same, at least one magnet 130 is positioned and enclosed between the first textile layer 116 and the second textile layer 118 at a position proximate the central transverse plane 110 that divides each shoulder strap into a left and right half.

As shown in FIG. 4, the second textile layer 118 is positioned onto the first textile layer 116 after the one or more magnets 130, 132 are positioned on the first textile layer 116, thereby sandwiching the magnets between the first and second textile layers 116, 118. The at least one magnet 130 is preferably a flat disc such that the magnet(s) will lie planarly parallel to the first and second textile layers 116, 118 during assembly.

Figure 6B:
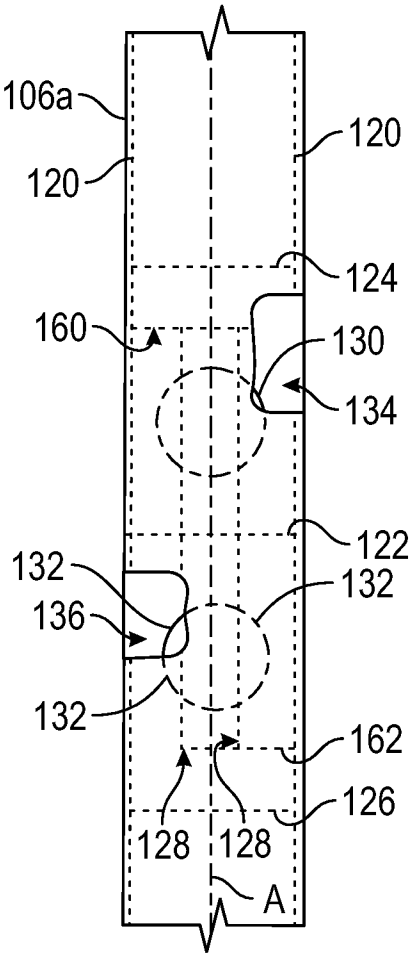
FIG. 6B is a top view showing placement of three transverse stitching lines and ornamental stitching to complete the shoulder strap.
Figure 6A:
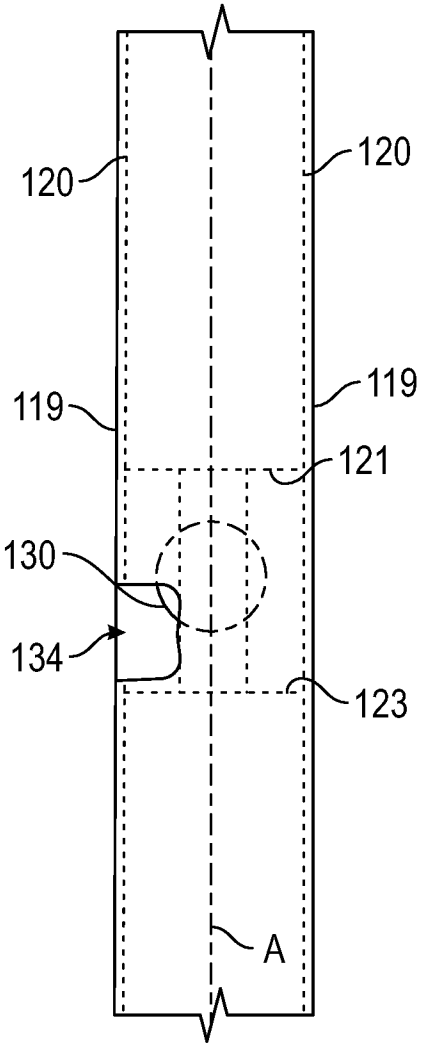
FIG. 6A is a top view showing placement of two transverse stitching lines to complete the shoulder strap.
Figure 5:
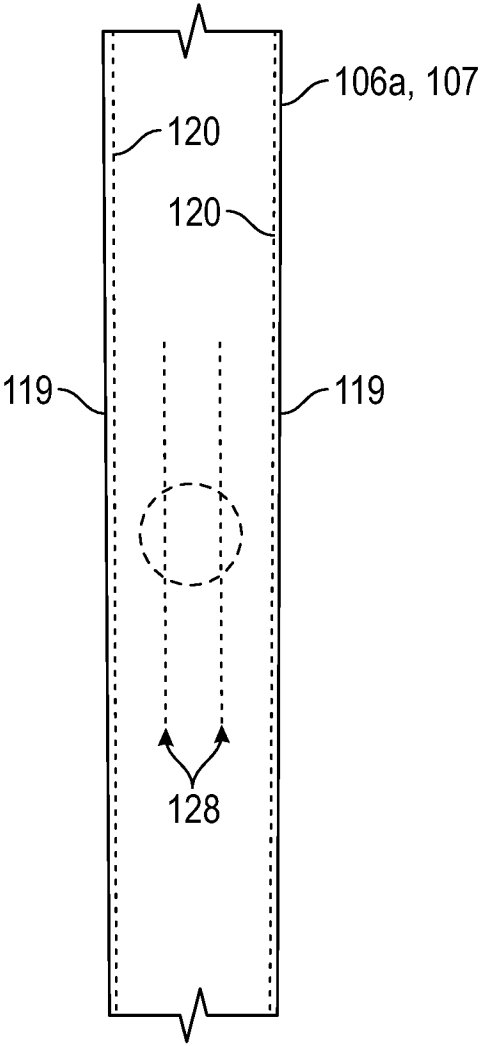
FIG. 5 is a top view of a partially assembled shoulder strap.

Turning now to FIGS. 5-6B, the first and second textile layers 116, 118 are sewingly stitched together along each longitudinal edge 119 by edge stitching 120 and are sewingly stitched together in FIG. 6A from edge to edge as a first line 121 and a second line 123, transverse to the longitudinal axis A of the first shoulder strap 106*a*, above and below the first magnet 130 (based on the orientation of the strap relative to the page (or to the left and right in FIGS. 2 and 3)) or in FIG. 6B from edge to edge in a first line 122 between the first magnet 130 and the second magnet 132 and a second line 124 above the first magnet 130 and a third line below the second magnet 132, each line being transverse to the longitudinal axis A. A longitudinal edge is the portion of any major surface that is most proximate a side of the respect textile layer. Each major surface of a textile layer has two, opposing longitudinal edges. As such, the first and second textile layers 116, 118 and the stitching 120, 121, 123 define a first enclosed chamber 134 housing the first magnet 130 as in FIG. 6A or the stitching 120, 122, 124, 126 define a first and a second enclosed chamber 134, 136, one each housing the first magnet 130 and a second magnet 132. The stitching added to the shoulder strap in FIGS. 5-6B occurs when the first textile layer 116 and the second textile layer 118 are stacked together and goes through to both textile layers. The only stitching present in a single textile layer, i.e., does not pass through both textile layers to fixedly attach the layers together, is the stitching stitched into each textile layer before introduction of the magnets and the stacking of the two textile layers as shown in FIG. 4 and the left two images of FIGS. 7 and 8.

Figure 9:
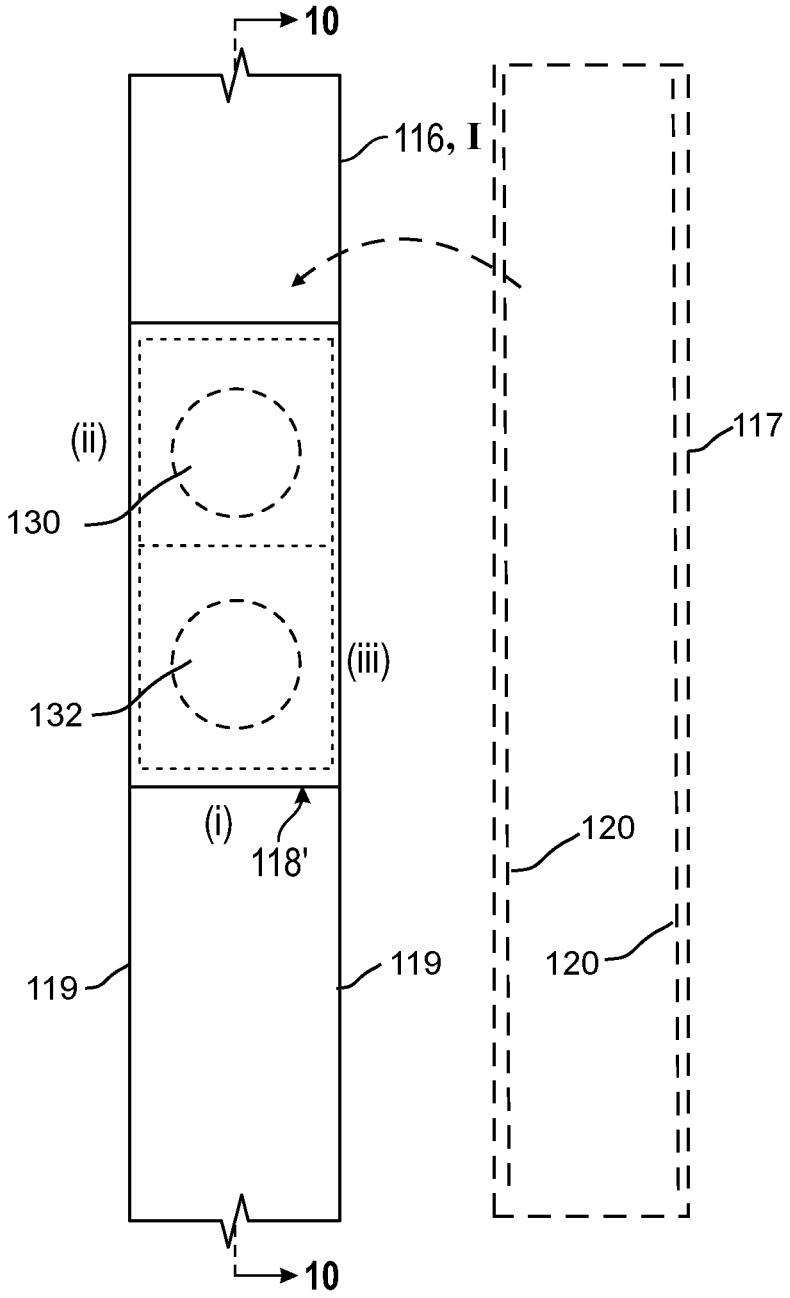
FIG. 9 is a top view of an alternate embodiment of a shoulder strap.
Figure 10:
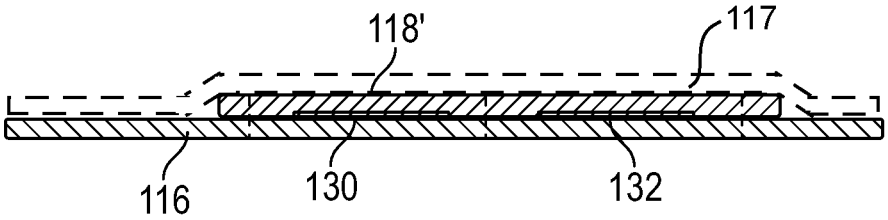
FIG. 10 is a longitudinal cross-sectional view of the shoulder strap of FIG. 9.

In the embodiments of FIGS. 4-8, the first and second textile layers 116, 118 are illustrated and described with edge stitching, thereby having layers of generally equivalent length. However, as illustrated in FIGS. 9 and 10, one of the first and second textile layers may be shorter than the other. As illustrated, the first textile layer 116 is the longer strip of material and second textile layer 118' is the shorter strip of material. The second textile layer 118' has a length that is long enough to cover the one or more magnets, e.g., first magnet 130 and second magnet 132 in FIG. 10, and provide enough material to fixedly attach opposing ends and opposing edges of a major surface to the first major side of the first textile layer 116. As discussed above, the fixed attachment may be sewn stitching, a heat fusible bond, or an adhesive bond. This is applicable to all embodiments.

The first and second textile layers 116, 118 may be made of the same textile material or of different textile materials. Suitable textile material includes, but is not limited to, canvas material, leather (natural or synthetic), denim, and webbing (natural or synthetic). In one embodiment, both the first and second textile layers 116, 118 are of a canvas style textile material. In another embodiment, both first and second textile layers 116, 118 are leather. If leather is selected, the leather may have a finished side or a painted side. Likewise, synthetic leather (pleather) can have a finished side or painted side. Woven material and webbing can have twined sides.

The magnets 130, 132 are illustrated as being round (and flat), but are not limited thereto. The magnets 130, 132 may be square, rectangular, hexagonal, or any other geometric shape commercially available that will rest comfortably against a user's shoulder while in use. The magnets may be Neodymium magnets, but are not limited thereto. In one embodiment, the magnets 130, 132 are round with a ⅞" diameter and a 1/32" thickness.

Figure 11:
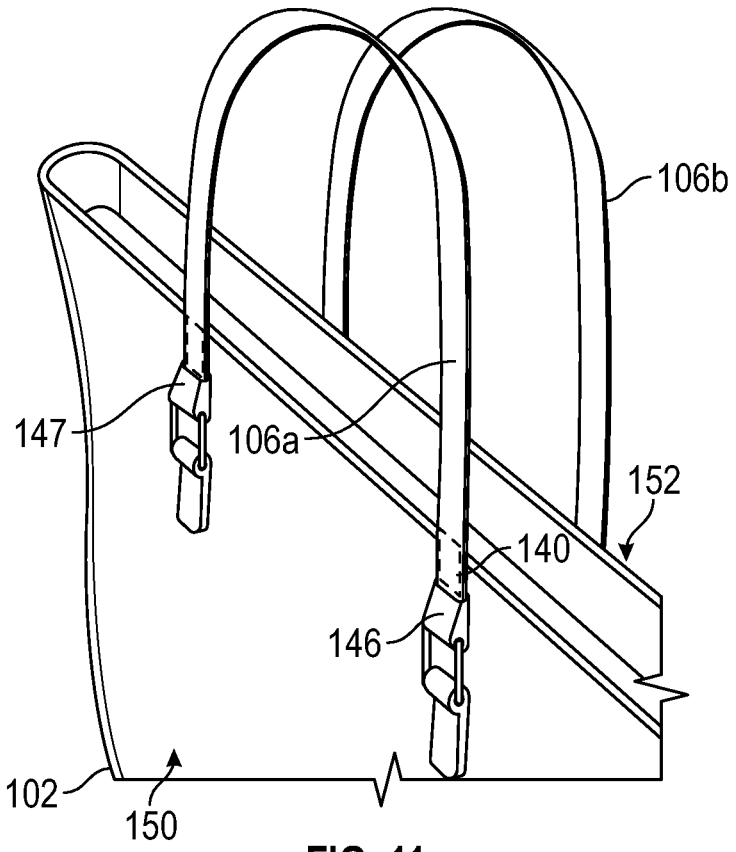
FIG. 11 is one exemplary type of fastening of the shoulder straps to the tote bag.
Figure 12:
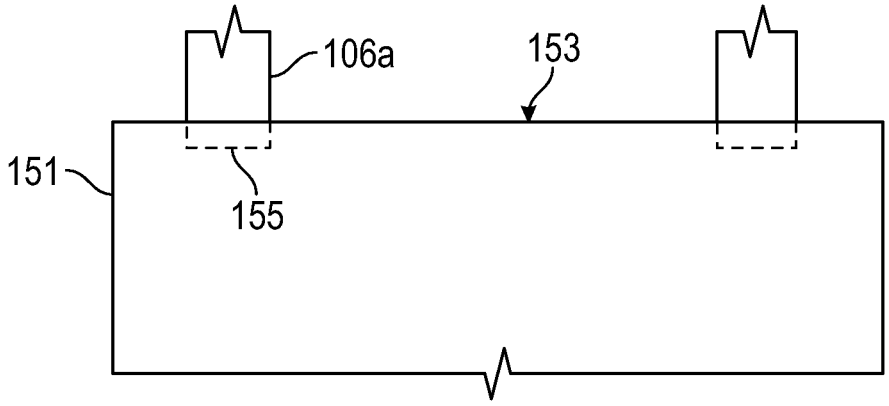
FIG. 12 is a second exemplary type of fastening of the shoulder straps to the tote bag.
Figure 13:
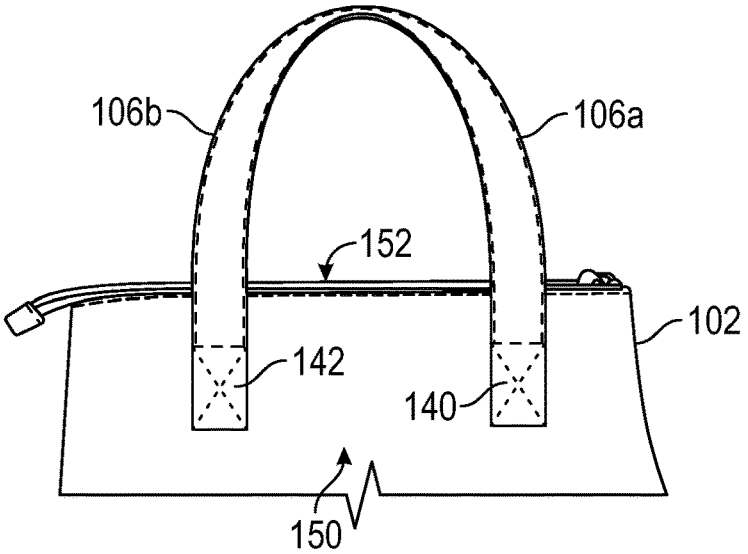
FIG. 13 is a third exemplary type of fastening of the shoulder straps to the tote bag.
Figure 14:
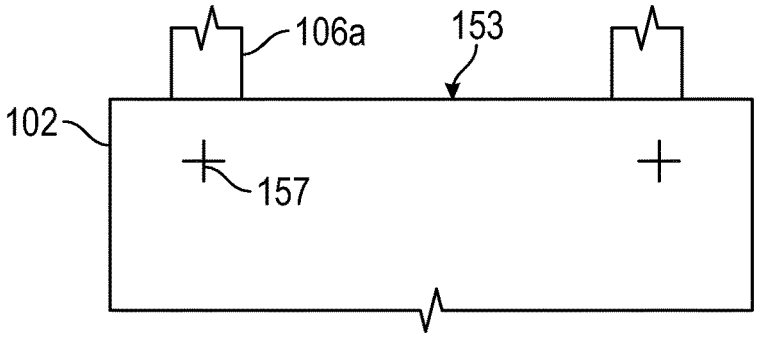
FIG. 14 is a fourth exemplary type of fastening of the shoulder straps to the tote bag.
Figure 15:
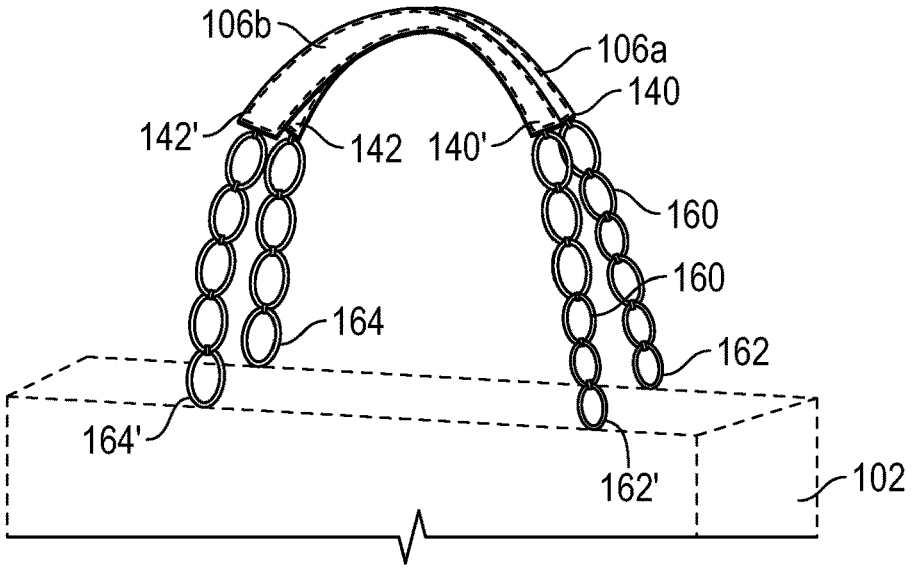
FIG. 15 is a fifth exemplary type of fastening of the shoulder straps to the tote bag.

Turning now to FIGS. 11-15, five nonlimiting strap attachment examples are presented. In FIG. 11, each of the plurality of straps 106*a*, 106*b* have first and second ends 140, 142 that terminate with a ring 144, 145 that has a tab 146, 147 affixed to the ring opposite each of the first end and second end 140, 142 respectfully. Each tab 146, 147 of the first strap 106*a* is fixedly attached to an exterior surface 150 of the carrying body 102 and each tab (not shown) of the second strap 106*b* is fixedly attached to an opposing exterior surface 152 of the carrying body 102. In FIG. 12, the first and second ends (not visible form the exterior) of the first strap 106 are positioned between an exterior textile layer 151 and an interior liner layer 153 and is stitched in place with stitching 155 or as part of the interior stitching of the construction that is not visible from the exterior. In FIG. 13, the first and second ends 140, 142 of the first strap 106*a* are fixedly stitched to an exterior surface 150 of the carrying body 102 and the first and second ends (not shown) of the second strap 106*b* are fixedly stitched to an opposing exterior surface 152 of the carrying body 102. In FIG. 14, the first and second ends (not visible from the exterior) of the first strap 106*a* are fixedly attached to an interior surface 153 of carrying body 102 by a fastener 157 inserted through the exterior surface of the carrying body, such as a rivet, grommet, decorative attachment, etc. In FIG. 15, the first and second sends 140, 142, 140', 142' of each strap 106*a*, 106*b* are defined by one or more links of chain 160 and the terminating link at each end 162, 162', 164, 164' of each strap 106*a*, 106*b* is fixedly attached to the carrying body 102.

Referring again to FIGS. 4-6B, a method of making one shoulder strap of a pair of shoulder straps is illustrated in sequential order including some optional ornamental stitching 128. The method is repeated to make the second shoulder strap of a pair of shoulder straps. The method includes providing four strips of textile material having a preselected length and a preselected width for making a shoulder strap, applying adhesive to a back side of a first strip 116 of the four strips of textile material at one or more preselected positions 134*a* and/or 134*b*; positioning a first magnet 130 with a first polarity thereof facing the back side (wrong side of the textile material) of the first strip 116 at or proximate a central transverse axis 111 that divides each shoulder strap into a first elongate half and a second elongate half, wherein the first magnet 130 is at one of the preselected positions of adhesive 134*a* or is adjacent and between two of the preselected positions of adhesive 134*b*, placing a second strip 118 of the two strips of textile material with a back side (wrong side of the textile material) thereof facing the first magnet 130 and facing the back side of the first strip 116 with their respective preselected length and preselected width aligned, stitching along the length of each of the opposing elongate edges of the layered first strip and second strip 107 (FIG. 5), stitching a first sewing line 121 and a second sewing line 123 from elongate edge 119 to elongate edge 119 transverse to the central longitudinal axis A of the layered first strip and second strip 107, wherein the first and second sewing lines 121, 123 are proximate the first magnet 130 and define an enclosed chamber 134 within which the first magnet 130 is positioned. These steps are repeated with a third strip of the four strips of textile material and a fourth strip of the four strips of textile material and respective magnets.

Any adhesive safe for use on the selected textile material is suitable for adhesively mounting two strips of textile material together. Rubber cement and Elmer's brand glue are two non-limiting examples.

In all embodiments, the method can include stitching parallel sewing lines 128 in at least one of the first strip 116 and the second strip 118 at or proximate the central transverse axis 111 before applying adhesive 134*a*, 134*b*, wherein the ornamental sewing lines 128 bisect the central transverse axis 111 and creates a generally U-shaped shape, but with straight parallel ends, in stitching on the top surface of a resulting first shoulder strap.

The method can additionally include positioning two magnets 130, 132 on the first strip 116 rather than just a first magnet 130. The additional magnet 132 is positioned adjacent to the first magnet 130 with its first polarity also facing the back side of the first strip 116. The magnets 130, 132 are spaced a preselected distance apart from one another proximate the central transverse axis 111 as shown in FIG. 4 to sewingly stitch the first textile layer 116 to the second textile layer 118 between the two magnets 130, 132, thereby forming one of the sewing line 122 in FIG. 6B, and stitching a third sewing line 126 from elongate edge 119 to elongate edge 119 transverse to the central longitudinal axis 111 proximate the additional magnet 132 to define an enclosed chamber 132 within which the additional magnet 132 is positioned. The method can also include stitching a pair of parallel stitching lines 128 parallel to the central longitudinal axis A of the first strip 116 before applying adhesive 134*a* and/or 134*b*, wherein the pair of parallel lines 128 are positioned to lie over the first magnet 130 and the additional magnet 132, and ultimately stitching sewing line 160 and 162 labeled in FIG. 6B to form the following general shape ⊨ on the first strip, which is centered elongately on the central longitudinal axis A of the first strip.

Figure 7:
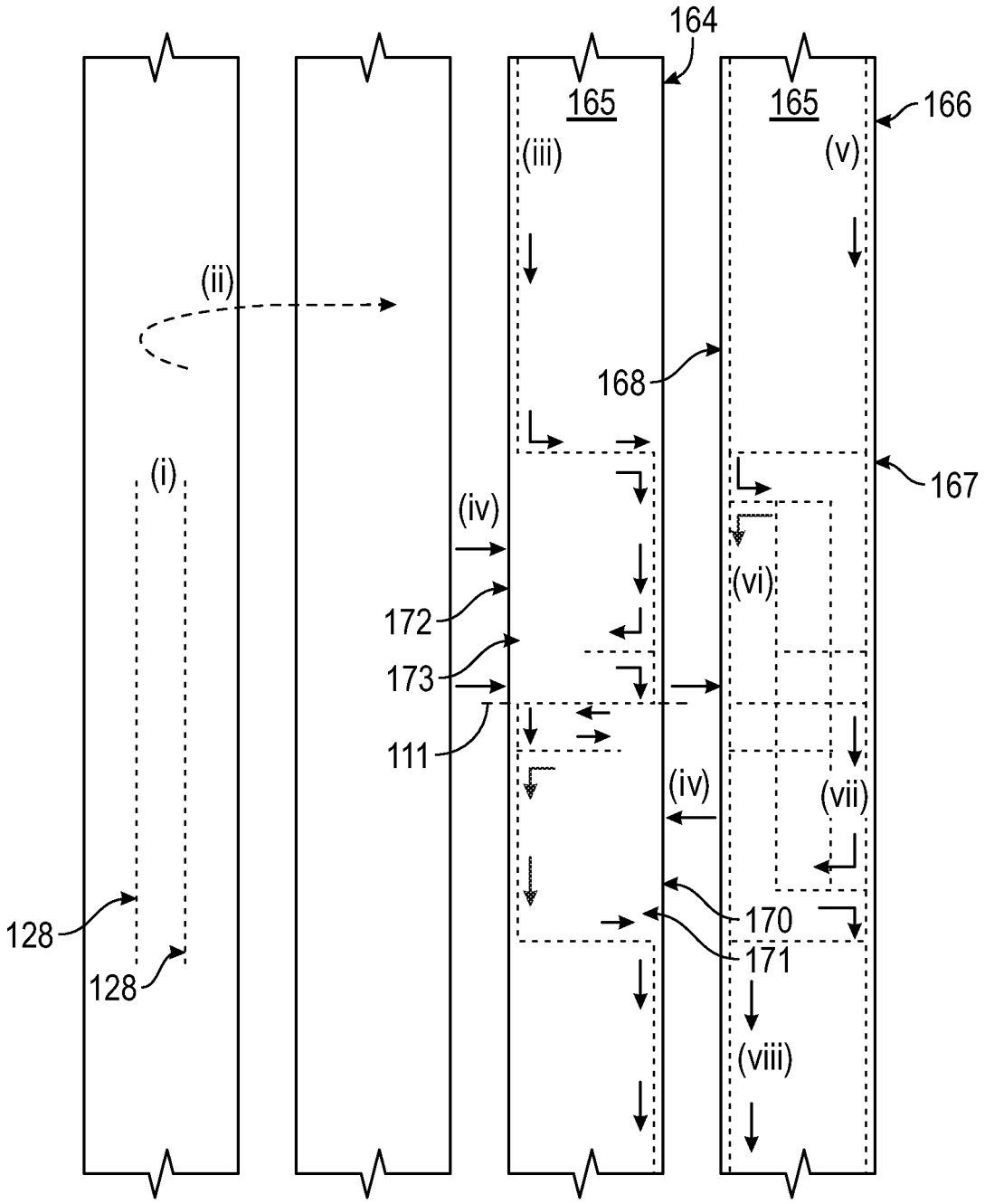
FIG. 7 is an alternate method of stitching the first and second textile layers together to include the ornamental stitching.
Figure 8:
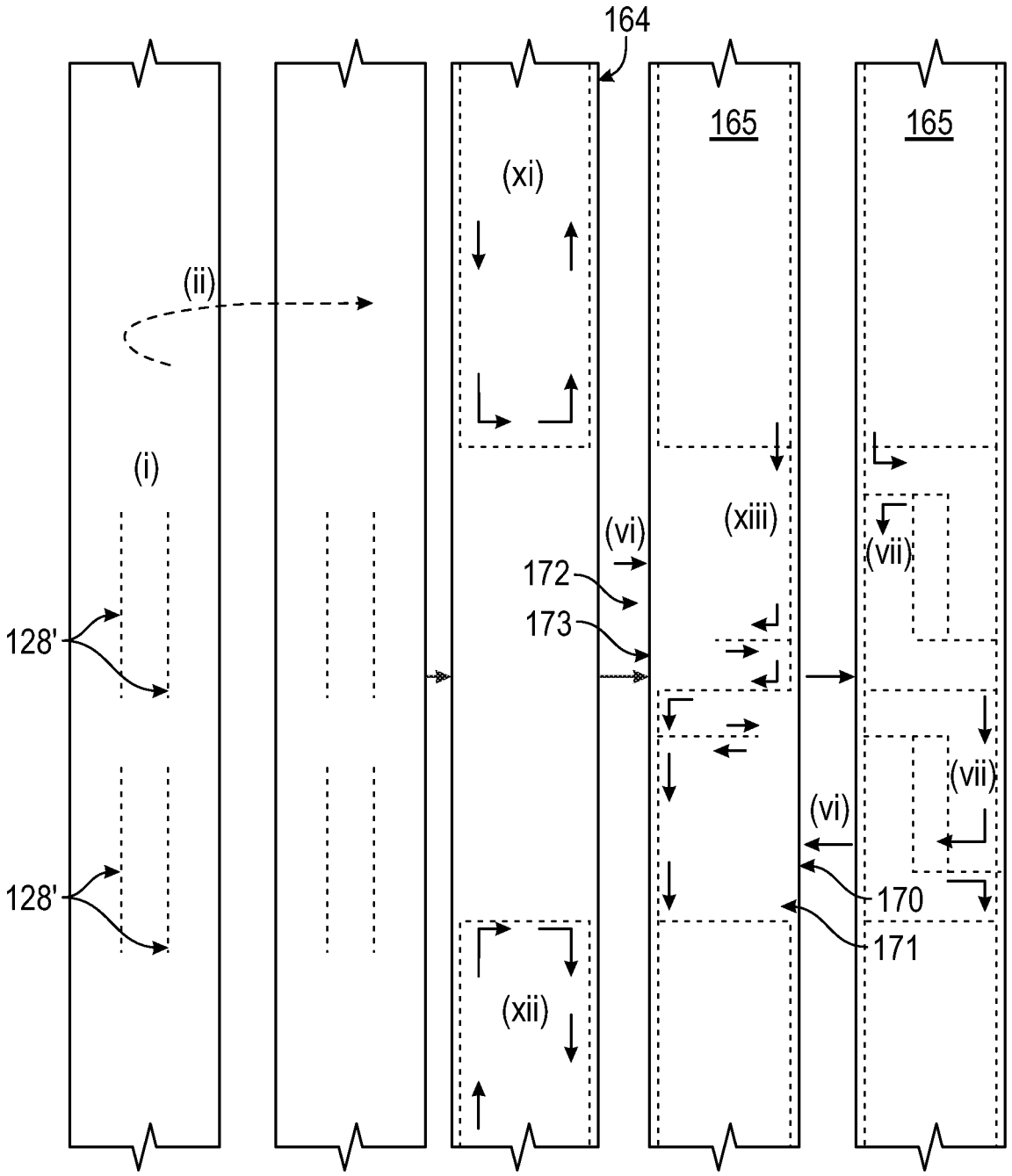
FIG. 8 is a second alternate method of stitching the first and second textile layers together to include the ornamental stitching.

Referring now to FIGS. 7 and 8, alternate methods of making a pair of shoulder straps are illustrated sequentially from left to right in the image. The methods include providing four strips of textile material having a preselected length and a preselected width for making a shoulder strap, positioning two of the strips of the four strips of textile material with wrong sides together with their respective preselected lengths and preselected widths aligned as shown by the letter (i) in FIGS. 7 and 8, thereby defining a first layered structure 164 having a top surface 165 and a bottom surface 166 connected by opposing sides 167, 168, then stitching the first layered structure 164 together to define a first pocket 170 sized to receive a first magnet 130 and a second pocket 172 sized to receive a second magnet 132, wherein the first pocket 170 has an open mouth 171 in a first of the opposing sides 167 and the second pocket 172 has an open mouth 173 in a second of the opposing sides 168 and wherein the first pocket 170 and second pocket 172 are on opposite sides of a central transverse axis 111' that divides each shoulder strap into a first elongate half and a second elongate half. As shown by the arrowed stitching pattern (iii) in FIG. 7, the two pockets 170, 172 can be formed using one continuous sewing pattern. Conversely, as shown in FIG. 8 by the sequential arrowed stitching patterns (xi), (xii), and (xiii), the two pockets 170, 172 can be formed by three separate sewing passes. Regardless of the sewing pattern used to form the two pockets 170, 172, once formed, a first magnet is positioned in the first pocket 170 and a second magnet is positioned in the second pocket 172 according to arrow (iv) in FIG. 7 with a first polarity of each of the first magnet and the second magnet oriented toward the top surface 165. Next, the open mouth 171 of the first pocket 170 and the open mouth 173 of the second pocket 172 are stitched closed.

Either of the processes discussed above with respect to FIGS. 7 and 8 is then repeated with two more of the four strips of textile material to define a second layered structure with a third magnet and a fourth magnet in the first and second pockets of the second layered structure, such that the polarity orientations of FIG. 17 (or the opposite thereof) results.

The method can also include stitching a pair of parallel stitching lines 128 parallel to the central longitudinal axis A of the first strip 116 before any other stitching occurs as shown in FIG. 7 or stitching two pair of parallel stitching lines 128' parallel to the central longitudinal axis before any other stitching occurs as shown in FIG. 8. The pair of parallel lines 128 or two pair of parallel lines 128' are positioned to lie over the first magnet 130 and the additional magnet 132, which will result in ornamental stitching on the pockets holding the magnets. In FIG. 8, and general shape ⊨ is formed on each pocket 170, 172. The shape is centered elongately on the central longitudinal axis (A) of the first strip. In FIG. 7, the shape shown above extends across both pockets 170, 172.

Referring again to FIGS. 9 and 10, the dashed box 117 represents a top textile layer to be positioned on top of the second textile layer 118' and the dashed lines therein represent positioning of edge stitching 120 when stitched to the first textile layer 116. The top textile layer 117 has a length generally equivalent to the first textile layer 116 to form the main body of a strap. The second textile layer 118' is shorter than the first textile layer 116. Yet, the second textile layer 118' has a length sufficient to cover the magnet(s) present, shown here as a first magnet 130 and a second magnet 132 and shown in FIG. 19 as a single magnet.

The first textile layer 116 is sewingly stitched to the second textile layer 118' with at least one magnet 130 positioned and enclosed therebetween at a position proximate or at a central transverse plane that divides the first textile layer into a left and right half to form an intermediate (I). A third or top textile layer 117 is sewingly stitched to the intermediate (I) along each longitudinal edge 119 by edge stitching 120 with the second textile layer 118' between the first textile layer 116 and the third textile layer 117. The second textile layer 118' can be hidden between the first textile layer 116 and the third textile layer 117. The polarity of the magnets 130 are oriented as described herein for all other embodiments so that the two straps lie flat one on top of the other.

In the embodiment of FIGS. 9 and 10, two magnets 130, 132 are spaced a preselected distance from one another proximate the central transverse plane. The first magnet 130 and the second magnet 132 can be adhered to one of the first or second textile layers 116, 118' with an adhesive. The stitching in the intermediate (I) can be as described herein for forming pockets that are subsequently sewn closed or can follow the perimeter of the magnet(s), thereby having generally the same shape as each magnet.

Figure 19:
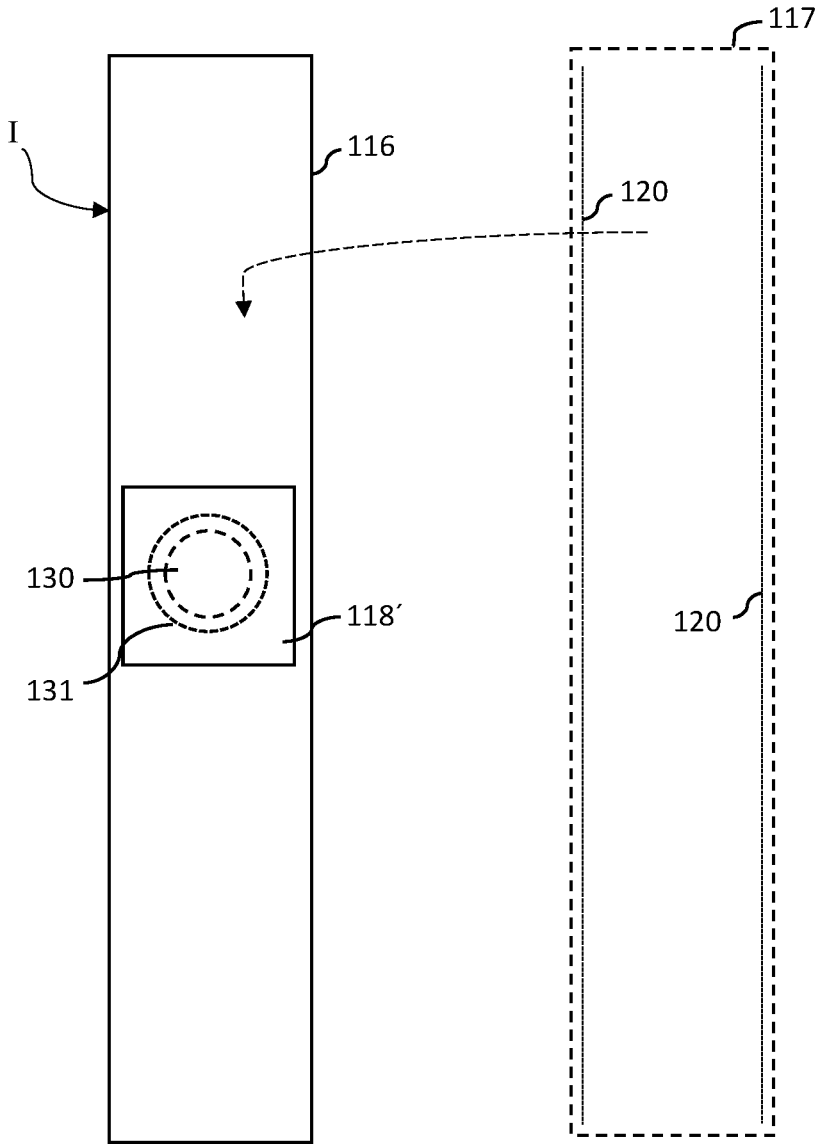
FIG. 19 is a top plan view of an intermediate strap form of a shoulder strap and of the top textile layer to be sewn thereto.

In all embodiments, the magnet(s) can be round, square, rectangular, oval, etc. The stitching in the intermediate (I) can be as described herein for forming pockets that are subsequently sewn closed. In the embodiment of FIG. 19, the magnet 130 is round and the stitching 131 in the intermediate (I) is a circular pattern around the magnet. The round magnet 130 can be adhered to one of the first or second textile layers with an adhesive before stitching occurs around the perimeter thereof.

In some embodiment, the second textile layer 118' is hidden between the first and third textile layers 116, 117 post-assembly. In one embodiment, the second textile layer 118' is an interfacing textile material. In another embodiment, the second textile layer 118' is a fabric textile material, that may be a woven or a non-woven fabric. In yet another embodiment, the second textile layer 118' is leather. Here, since the stitching 131 around the magnet 130 is in the intermediate (I), this stitching is not present in the third or top textile layer 117 of the strap. The stitching 131 around the magnet is only visible from the bottom of the strap. i.e., in the first textile layer 116. While one magnet 130 is shown in FIG. 19, there can of course be a plurality of magnets each sewn with stitching around the perimeter thereof.

Figure 18:
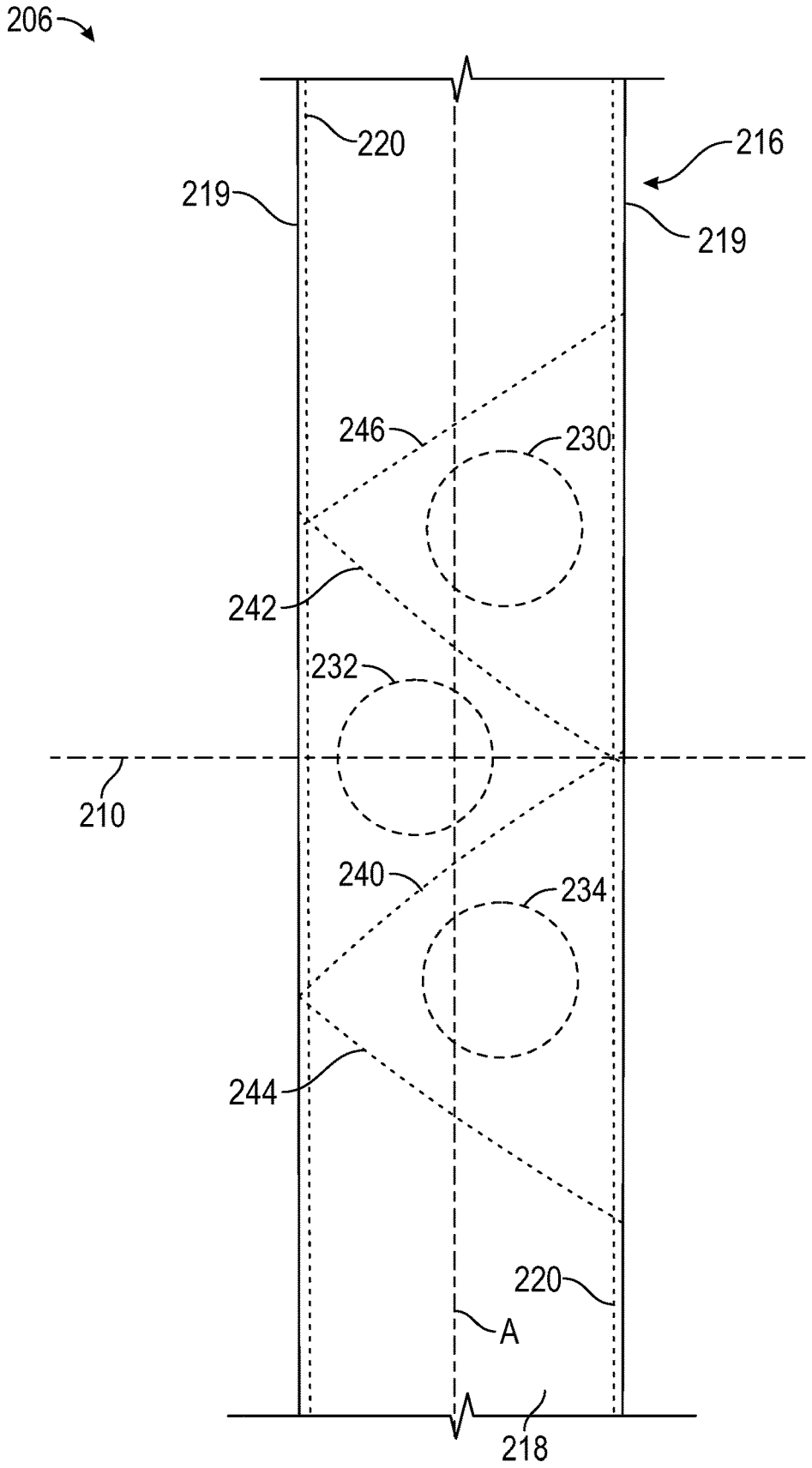
FIG. 18 is a top view of another alternate embodiment of a shoulder strap.

Turning now to FIG. 18, an individual strap 206 is shown that has transverse stitching that is angled relative to the elongate longitudinal axis (A), but still defines one or more pockets for the one or more magnets 230, 232, 234. The individual strap 206 is made from two strips of textile material having preselected lengths and a preselected width for making the shoulder strap. The two strips of textile material are oriented with wrong sides together, thereby defining a first layered structure. If just magnet 232 is to be present, the two strips are stitched together to define a "V" shape via stitching lines 240, 242, which have an apex of the V aligned with the central transverse plane 210. If a plurality of magnets are to be present, the two strips are stitched together to define a "W" shape via stitching lines 240, 242, 244, 246 with the "W" centered with the central transverse plane 210. With the "W" shape stitching, pockets are formed that are open in opposing directions, left and right facing based on the orientation of FIG. 18 to the page. Magnets 230 and 234 may be present or magnets 230, 232, and 2343 may be present. Magnet 232 may be milted to enhance the flexibility of the strap about the central transverse plane. The "V" shape and the "W" shape can be formed using one continuous sewing pattern. Conversely, each stitching line can be sewn separately. Regardless of the sewing pattern used to form the two pockets 170, 172, once formed, a first magnet is positioned in the selected pockets. Then, the open mouths of each pocket is stitched closed. This stitching may be accomplished by edge stitching 220 along each longitudinal edge 119. Rather than have pointed apex(es), the "V" and "W" apexes may be more rounded, thereby the stitching is more "U-shaped" or an undulating "S-shape."

It should be noted that the embodiments are not limited in their application or use to the details of construction and arrangement of parts and steps illustrated in the drawings and description. Features of the illustrative embodiments, constructions, and variants may be implemented or incorporated in other embodiments, constructions, variants, and modifications, and may be practiced or carried out in various ways. Furthermore, unless otherwise indicated, the terms and expressions employed herein have been chosen for the purpose of describing the illustrative embodiments of the present invention for the convenience of the reader and are not for the purpose of limiting the invention.

Having described the invention in detail and by reference to preferred embodiments thereof, it will be apparent that modifications and variations are possible without departing from the scope of the invention which is defined in the appended claims.

What is claimed is:

1. A carrying device comprising:

a carrying body defining an interior storage compartment having an access opening thereto and having a pair of shoulder straps defining an opening sized to receive the arm of a user and to rest upon a shoulder of the user, each individual strap of the pair of shoulder straps comprises:

a first textile layer sewingly stitched to a second textile layer that is shorter than the first textile layer with at least one magnet positioned and enclosed therebetween at a position proximate or at a central transverse plane that divides the first textile layer into a left and right half to form an intermediate; wherein the second textile layer has a length that covers the at least one magnet;

a third textile layer sewingly stitched to the intermediate along each longitudinal edge by edge stitching with the second textile layer between the first textile layer and the second textile layer;

wherein the polarity of the at least one magnet in the first individual strap of the pair of shoulder straps and the polarity of the at least one magnet in the second individual strap of the pair of shoulder straps are oriented with the same polarity facing a top surface thereof, thereby the first strap is magnetically attractable to the second strap with a bottom surface of the first strap in direct contact with a top surface of the second strap or with a bottom surface of the second strap in direct contact with a top surface of the first strap.

2. The carrying device of claim 1, wherein the at least one magnet is a round magnet.

3. The carry device of claim 2, wherein the stitching in the intermediate is a circular pattern around the round magnet.

4. The carrying device of claim 3, wherein the at least one magnet is adhered to one of the first or second textile layers with an adhesive.

5. The carrying device of claim 1, wherein the at least one magnet comprises two magnets spaced a preselected distance from one another proximate the central transverse plane.

6. The carrying device of claim 5, wherein the first magnet and the second magnet are adhered to one of the first or second textile layers with an adhesive.

7. The carrying device of claim 1, wherein the stitching in the intermediate follows the perimeter of the at least one magnet, thereby having generally the same shape as the at least one magnet.

8. The carrying device of claim 1, wherein the carrying device is selected from the group consisting of a tote bag, a carry-on bag, a handbag, a shopping bag, lap-top bag, travel bag, diaper bag, pet carrier, and a beach bag.

9. The carrying device of claim 1, wherein the second textile layer is hidden between the first and third textile layers.

10. The carrying device of claim 9, wherein the second textile layer is an interfacing textile material.

11. A method of making a pair of shoulder straps comprising:

providing four strips of textile material each having a preselected length and each having a preselected width for making a shoulder strap;

providing two pieces of intermediate textile material that are shorter and have the same or a smaller width than the four strips of textile material;

positioning a first magnet with a first polarity thereof facing the back side of a first strip of the four strips of textile material at or proximate a central transverse axis that divides each shoulder strap into a first elongate half and a second elongate half, wherein the first magnet is at or is adjacent the central transverse axis;

placing a first piece of the intermediate textile material in direct contact with the first magnet;

stitching around the perimeter of the first magnet to fix the first piece of the intermediate textile material to the first strip;

placing a second strip of the four strips of textile material with a back side thereof facing the intermediate textile material with the length thereof aligned with the length of the first strip;

stitching along the length of the opposing elongate edges of the layered first and second strips; and repeating the above with a third strip and a fourth strip of the four strips of textile material with a second magnet.

12. The method of claim 11, comprising applying adhesive to a back side of a first strip of the four strips of textile material at one or more preselected positions for the at least one magnet.

13. The method of claim 11, wherein the adhesive is a heat fusible bond material.

* * * * *